US005675887A

United States Patent [19]

Gajewski et al.

[11] Patent Number: 5,675,887

[45] Date of Patent: Oct. 14, 1997

[54] ERROR FREE RIVET SYSTEM

[75] Inventors: Gerard H. Gajewski, Dover; Gerald T. Scala, Rochester, both of N.H.; Michael J. Allen, Bloomfield Hills, Mich.

[73] Assignee: Davidson Textron Inc., Dover, N.H.

[21] Appl. No.: 505,400

[22] Filed: Jul. 21, 1995

[51] Int. Cl.[6] ..... B23P 21/00

[52] U.S. Cl. ..... 29/702; 29/407.05; 29/525.06; 29/715; 29/720; 29/243.53

[58] Field of Search ..... 29/407.04, 407.05, 29/407.09, 524.1, 525.06, 702, 707, 714, 715–720, 721, 243.521, 243.53, 281.1, 281.5, 812.5

[56] References Cited

U.S. PATENT DOCUMENTS 4,754,643 7/1988 Weeks, Jr. et al. ..... 29/812.5
4,901,431 2/1990 Gast ..... 29/707
5,035,353 7/1991 Smart et al. ..... 29/243.521
5,125,151 6/1992 Smart .
5,357,668 10/1994 Roberts ..... 29/715

*Primary Examiner*—David P. Bryant
*Attorney, Agent, or Firm*—Reising, Ethington, Barnard & Perry

[57] ABSTRACT

A rivet system (10) locks separate parts (12, 14) of an assembly (13) together on a support fixture (20) with the clamping devices (28); which prevents release of the parts (12, 14) from the fixture (20) until a required number of rivets (51) have been counted. A rivet setting tool (50) provides insertion of the rivets (51) between the parts (12, 14), and which disposes spent rivet mandrels (62) through a vacuum tube (58) to be sensed and counted. A controller (100) automatically locks the parts in the support fixture and counts the sensed mandrels (62) to allow release of the assembly (13) only upon a predetermined count of mandrels (62).

21 Claims, 5 Drawing Sheets

ERROR FREE RIVET SYSTEM

TECHNICAL FIELD

The invention relates to riveting systems, and more particularly to riveting systems which count the number of spent rivets and limit release of a riveted part until a predetermined number of rivets is determined.

BACKGROUND OF THE INVENTION

In the riveting of assemblies for connecting at least two parts together, it is common practice to provide visual inspection after the rivets have been applied by an operator with a hand-held, power-operated, rivet setting tool to assure that the predetermined number of rivets has been applied. Such may be used on air bag door assemblies in an automotive instrument panel wherein a certain number of rivets are required in order for the door assembly to be correctly secured to the instrument panel. Before the instrument panel with the air bag door assembly is allowed to be removed for subsequent assembly with the remainder of the air bag system in a vehicle, the operator visually ensures that the predetermined number of rivets have been installed. This is a significant time consuming and tedious task, and the operator can be distracted and err in carrying out such important assignment. There is limited ability to control the quality of such riveting process by an operator.

Where the rivets used are of the blind type having a break-away, rivet-setting mandrel, it has been proposed as disclosed in U.S. Pat. No. 5,125,151, issued Jun. 30, 1992 in the name of Smart, to count the number of rivets that are set in a work cycle on an assembly by sensing the spent mandrels with a proximity switch as they are carried away from the riveting tool by vacuum collection tube. When the mandrel count at the end of the work cycle is less than the prescribed number of rivets to be applied, a warning light is activated and the system is disabled from starting another work cycle until the required number of spent mandrels has been counted.

However, this patent does not preclude the possibility of a riveted assembly with less than the required number of rivets from nevertheless being removed from the riveting workstation and sent on for its intended use.

SUMMARY OF THE INVENTION

The subject invention specifically addresses the above-mentioned concern in addition to providing other advantages with a rivet system wherein the rivets are counted and the parts being riveted are locked against removal from the workstation by the operator until the required number of rivets has been counted. This is accomplished in a very cost effective manner by providing an assembly holding fixture at the workstation wherein the parts to be riveted are held together on the fixture for further riveting by one or more power operating clamping devices that are controlled by a controller. A detecting device is provided that produces a signal indicating each time a rivet is applied to the parts of the clamped assembly by a rivet setting tool and the controller is responsive to the rivet applied signal to prevent release by the clamping devices of the parts and thereby of the assembly from the fixture until a prescribed number of signals has occurred corresponding the number of rivets required for correct assembly of these parts. The subject invention thus provides for taking advantage of one or more fixture clamps that are normally used to clamp the parts in proper relationship for the riveting by extending the use of the clamps with the addition of a controlled locking feature.

It is therefore an object of the subject invention to provide a new and improved riveting system for assuring that the correct number of rivets are used in securing the parts of an assembly together. Another object is to positively prevent removal of a rivetted assembly from a workstation until there is reliable indication that the required number of rivets has been used in securing the parts of the assembly together. The assembly and parts are locked together on riveting fixture with at least one fixturing clamp and prevent their release from the fixture by unlocking the fixturing clamp until the required number of rivets to correctly secure the parts together has been counted as they are set on the parts. The provides a very cost effective riveting system in a workstation for assuring that an assembly is riveted together with a prescribed number of rivets before it is allowed to be removed from the workstation by the operator.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE EMBODIMENT

Figure 1:
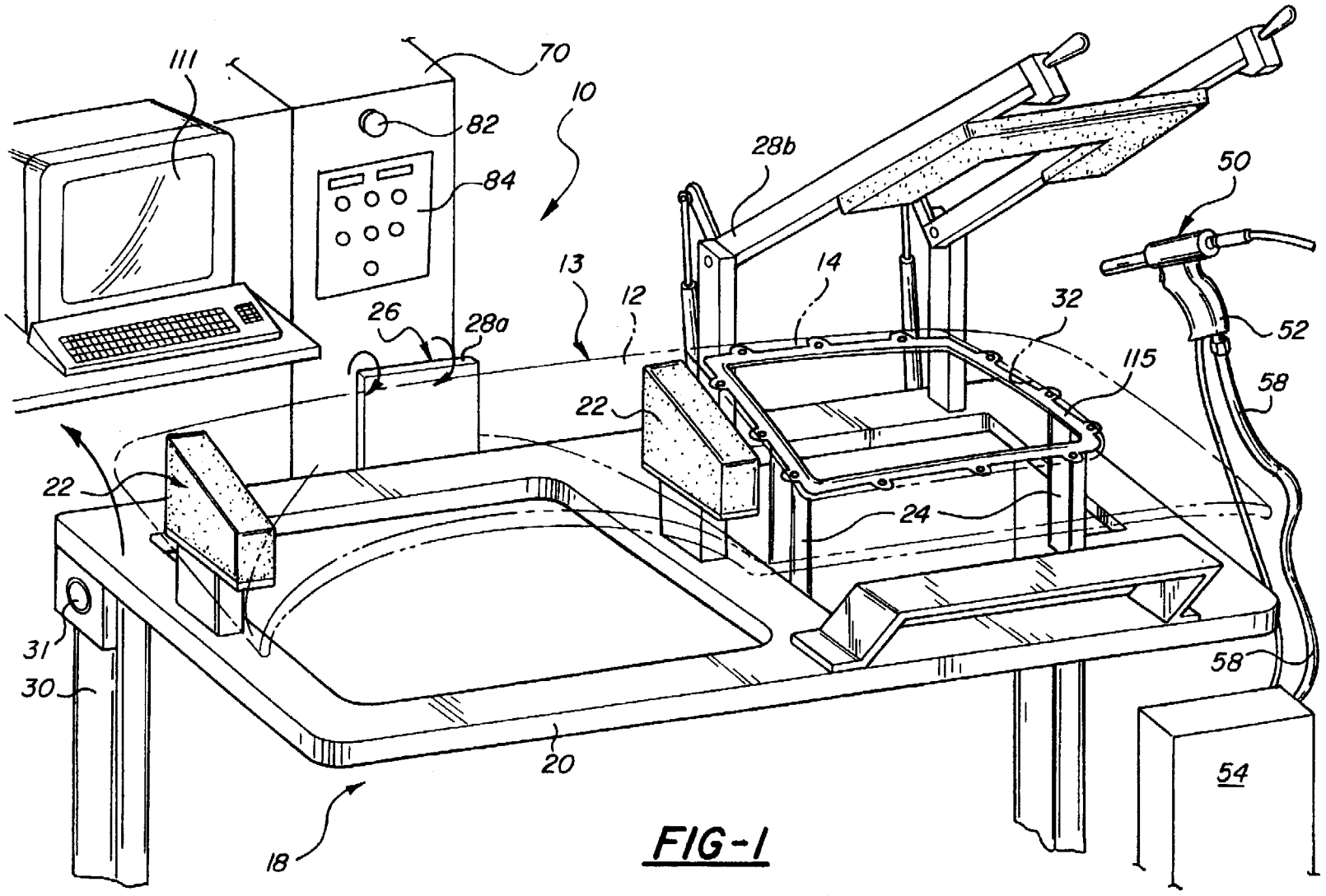
FIG. 1 is a perspective view of the riveting system as applied to an air bag door assembly in an automotive instrument panel.
Figure 2:
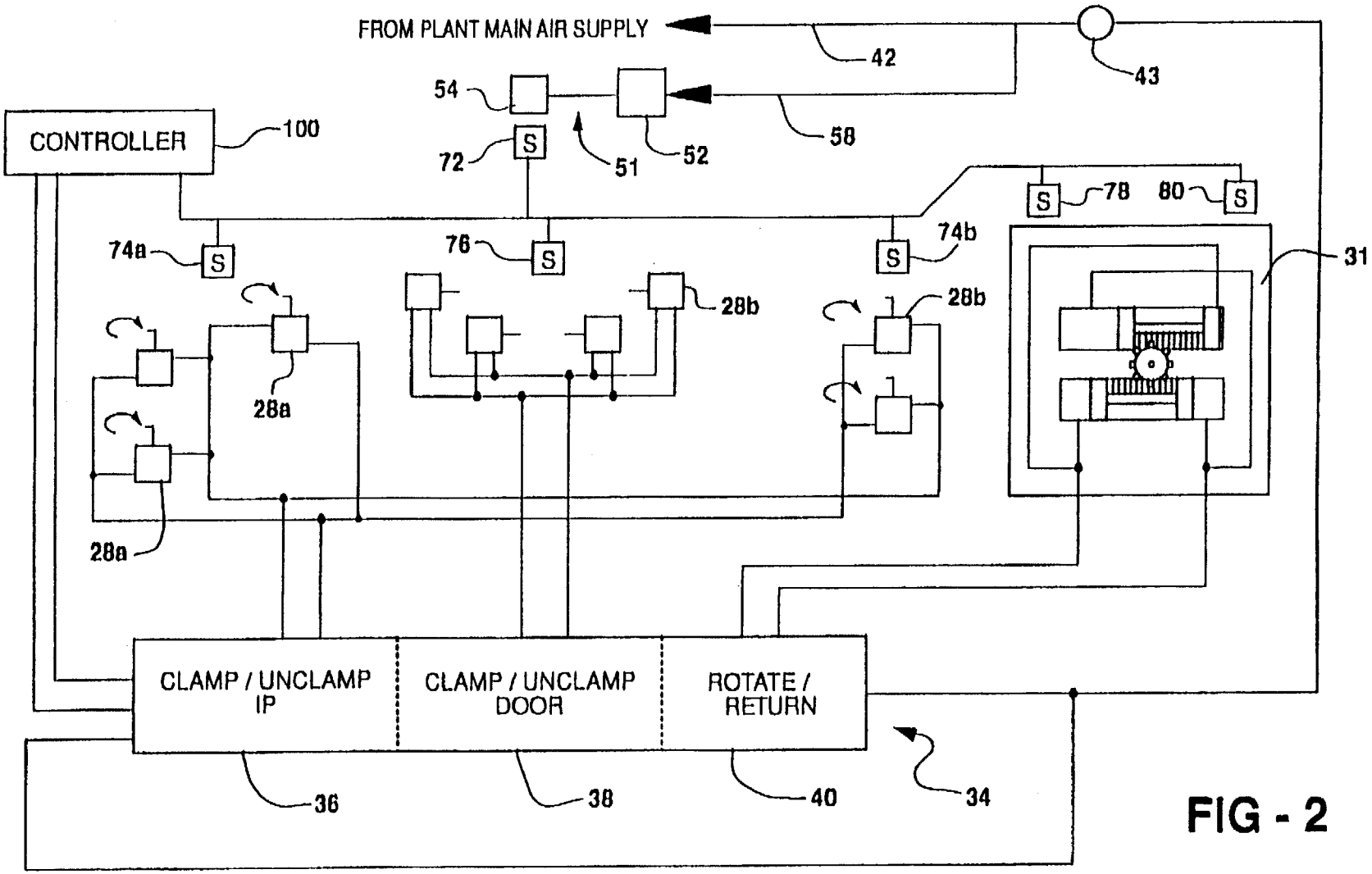
FIG. 2 is a diagrammatic view of the system controls of the riveting system of FIG. 1.

A riveting system 10 for ensuring the riveting together of at least two members or parts 12, 14 with a predetermined number of rivets 51 at a workstation 18 prior to removal of the so formed assembly 13 of connected parts 12, 14 from the workstation 18, is generally illustrated in FIG. 1.

The riveting system 10 includes a support fixture 20 connected to the workstation 18 for receiving and supporting the at least two parts 12, 14. The support fixture 20 allows the parts 12, 14 to be held and secured thereto during riveting of the parts 12, 14 to one another forming the assembly 13. In the preferred embodiment, the riveting system 10 is used to rivet an air bag door to an instrument panel 12. The first part 12 is equivalent to the instrument panel and the second part 14 is equivalent to the air bag door. However, other parts may be riveted together under the teachings of this invention, as can be clearly understood by one skilled in the art.

The support fixture 20 generally includes a first support portion 22 and a second support portion 24. The first support portion 22 supports the first member or instrument panel 12 in a predefined position with the second part or air bag door 14 being supported by the second support portion 24. In the illustrated embodiment, the instrument panel 22 includes an opening 32 therein sized to receive the air bag door 14 in the opening 32 for riveting in place. The support portions 22, 24 are generally comprised of support pads for placement of the parts 12, 14 in the predetermined positions.

The riveting system 10 also includes a locking apparatus 26 operatively connected to the support fixture 20 to hold and lock the two members 12, 14 together on to the support fixture 20. The locking assembly 26 includes a plurality of clamps 28 for locking each of the two members 12, 14 to the support fixture 20 adjacent and aligned with one another in the predefined positions. In the preferred embodiment, the clamps 28 are pneumatically controlled, as subsequently discussed. The clamps 28 include a plurality of panel clamp 28*a* (only a portion indicated in FIG. 1) which are positioned about the circumference of the instrument panel 12 to clamp the instrument panel 12 against the support fixture 20. The clamps 28 also include a plurality of door clamps 28*b* (only a portion indicated in FIG. 1) positioned adjacent the door 14 when positioned within the instrument panel 12 to clamp same thereagainst and to the fixture 20. It should be understood that manually actuated clamps may be used in addition hereto to aid the user in positioning the parts 12, 14.

In the preferred embodiment, the support fixture 20 with the panel support portion 22 and door support portion 24 is rotatable with respect to the workstation 18 by a rotating apparatus 31, generally a rack and pinion gearing. The support fixture 20 is rotatably supported on a base support 30. In operation, the instrument panel 12 and door, 14 are placed on the rotatable fixture 20 with the finish side facing upward and the working side down for clamping in the unrotated or return position. Once clamped, the rotatable fixture 20 rotates approximately 180° to expose the working side or backside of the parts 12, 14 in a rotated position. It is the backside of the parts 12, 14 which are operated on and riveted for connection thereof.

The riveting system 10 includes actuator assembly 34 for activating and deactivating the clamps 28 and rotation of the fixture 20. The actuator assembly 34 includes panel and door locking actuators 36, 38 and a rotating actuator 40. The actuator assembly 34 in the preferred embodiment is pneumatic based; however, other types of systems may be utilized as can be appreciated by those skilled in the art, such as electronic, hydraulic, etc. The locking actuators 36, 38 are connected to the clamps 28 for controlling clamping and unclamping in response to control signals, as subsequently discussed. The clamps 28*a* used to clamp the first part or panel 12 are roto-shaft clamp cylinders, preferably five in number. The clamps 28*b* used to clamp the second part or door 14 are linear clamp cylinders, preferably four in number.

The actuator assembly 34 is connected to a main air supply line 42 supplying approximately 95 psi through regulator 43.

The locking actuators 36, 38 are comprised of a series of pneumatic solenoids and valves for switching air pressure to the pneumatic clamps 28 to cause clamping and unclamping in response to control signals, to control the solenoids to selectively supply air controlling clamping and unclamping. Such pneumatic control systems are commonly understood known in the art.

The rotating actuator 40 generally comprises a rollover actuator, such as phd inc., to pneumatically control rotation and return of the fixture 20. The rotating actuator 40 controls the rack and pinion drive gearing 31 which is directly connected to the fixture 20.

The riveting system 10 also includes a rivet setting tool 50 operable to apply rivets 51 to the at least two members 12, 14 to connect the members 12, 14 to one another forming the assembly 13. The rivet setting tool 50 may be as those commonly known in the art, such as the ATG Multihead Remote System by Avdel Corporation. The rivet setting tool 50 includes a hand-held placing head 52 and remote vacuum collection unit 54 to remove spent rivet mandrels 62 from the placing head 52 by transferring the spent mandrels 62 through a vacuum tube 58 to the collection unit 54.

Figure 3:
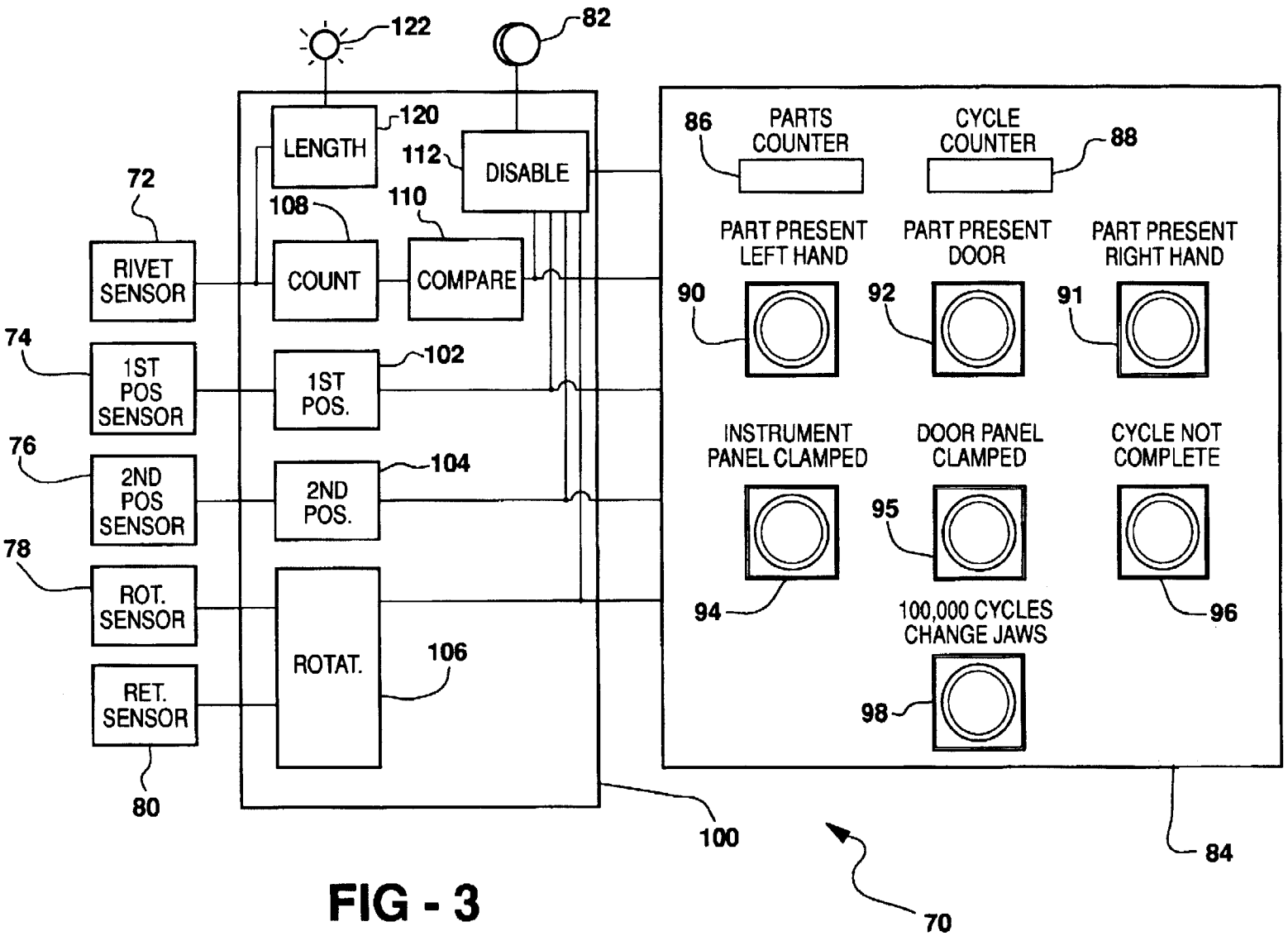
FIG. 3 is a schematic diagram of the controller and display panel.
Figure 4:
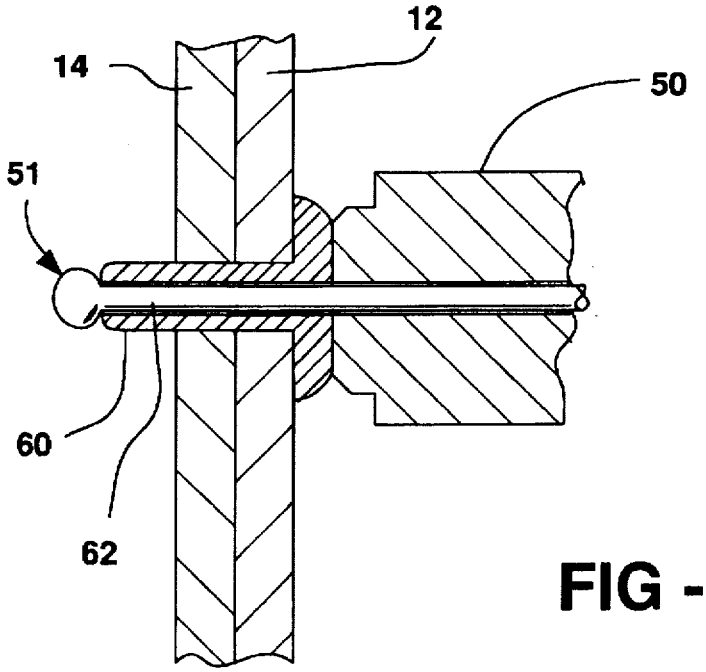
FIG. 4 is a sectional view illustrating the insertion of a rivet in the air bag door assembly in FIG. 1.
Figure 5:
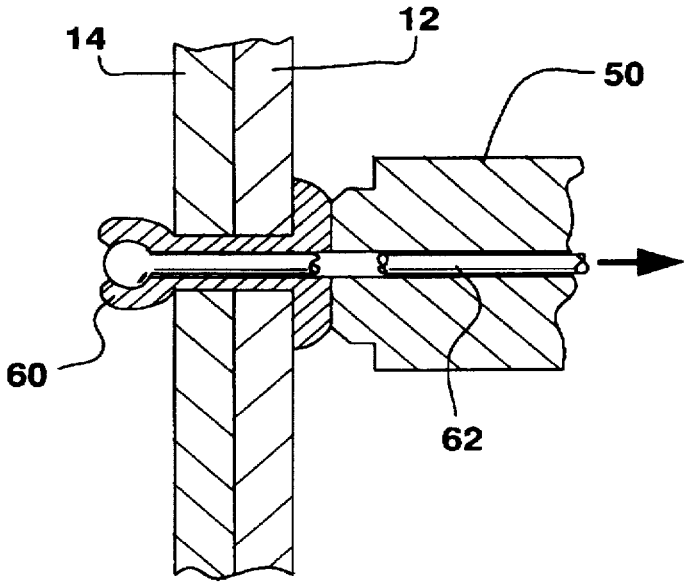
FIG. 5 is a section view as in FIG. 4 illustrating break away of the spent mandrel.

As known in such a rivet setting tool 50, the rivets 51 are set with the placing head 52, as illustrated in FIG. 3. The unused or unspent rivets 51 comprise a partially formed hollow rivet body 60 and a mandrel 62 comprising a rivet head at the partially formed insertion end of the rivet body 60 and a stem that extends through the rivet body 60 and which is grasped and held by the setting tool 50. The mandrel 62 is forced through the hollow rivet body 60 upon insertion into the parts 12, 14. The stem of the mandrel 62 is broken and disposed through the vacuum tube 58, e.g., the spent rivet mandrel, as illustrated in FIG. 5.

The rivet system 10 also includes a system control apparatus 70 operatively connected to the locking assembly 26 and the rivet setting tool 34 to prevent release of the members 12, 14 and assembly 13 until determining that a predetermined number of rivets 51 have been set.

The system control apparatus 70 includes a rivet sensor 72 connected to the rivet setting tool 50 for detecting the occurrence rivet placement and for producing a count signal upon detection of each of the spent rivet mandrels. In the preferred embodiment, the rivet sensor 72 is connected to the vacuum tube 58 to detect the spent rivet mandrels passing therethrough. The rivet sensor 72 may be of any type including proximity, infrared, optical, etc. Generally, at least a portion of the vacuum tube 50 is clear allowing use of an optical sensor.

The system control apparatus 70 counts the number of mandrels 62 detected in the vacuum tube 58 by the count signal from the rivet sensor 72. Release of the locking apparatus 26 occurs upon obtaining the predetermined count. In the preferred embodiment, fifteen rivets 51 are placed or set in the assembly 13 to secure the two parts 12, 14 together comprising the predetermined count. However, it is to be understood that any other count may be selected as required by the parts being connected.

The system control apparatus 70 includes a pair of first part sensors 74 for determining the proper placement and presence of the instrument panel or first part 12. The first sensors 74 are spaced to detect opposite ends of the first part 12, i.e., right and left side. A second part sensor 76 detects the presence and proper placement of the door or second part 14. Each of the sensors 74, 76 produces an electronic signal indicating whether the part 12, 14 is present or not. Such sensors 74, 76 may be any type to indicate whether or not the parts are properly located on the fixture 20, such as contact sensors, proximity, optical, etc. In the preferred embodiment, such sensors 74, 76 include a proximity sensor, commonly available from phd inc.

There is also included a rotate sensor 78 and a return sensor 80 for indicating complete rotation or return, respectively, of the support fixture 20 between the rotated position and the return position. Each of the sensors 78, 80 may be proximity sensors, or any other position sensors as commonly known in the art. In the preferred embodiment, the sensors 78, 80 are proximity sensors also available from phd inc. The sensors 78, 80 produce a control signal upon actuation or detection thereof.

A control switch 82 is connected to the workstation 18 to allow automatic operation by the operator to cause clamping and rotation of the parts 12, 14 for riveting thereof, and return upon completion of the riveting.

The system control apparatus 70 includes a status panel 84 for indicating various statuses of the system control apparatus 70. The status panel 84 includes a plurality of indicators comprising lights and numeric counters. A parts counter 86 indicates the number of rivets counted from the rivet setting tool 50 for a particular assembly 13. The cycle counter 88 indicates the number of assemblies 13 formed. Two of the indicators 90, 91 are responsive to the first part sensors 74 and indicate whether the first part 12 is present (right 91 and left 90 sides, separately). A third indicator 92 is responsive for the second part sensor 76 and indicates whether the second part or door 14 is present. Another pair of clamp indicators 94, 95 indicate when the instrument panel 12 is clamped and the door 14 is clamped, respectively, and therefore being rotated (clamped) and unrotated (unclamped). An alarm indicator 96 indicates that the cycle is not complete, i.e., when there are not exactly the predetermined number of rivets counted and the support fixture 20 is attempted to be rotated. A cycle indicator 98 indicates when a predetermined number of cycles is reached to require service on the support fixture 20. The indicators 90, 91, 92, 94, 95, 96 are generally comprised of lights to indicate the status thereof. The counters 86, 88 are generally comprised of digital electronic counters.

The system control apparatus 70 includes a controller 100 for receiving the signals from the sensors 74, 76, 78, 80 and for controlling the fixture 20 movement and clamping and status panel 84. The controller 100 provides the control signals to the actuator assembly 34 in response to the sensor signals and control switch 82, according to the flowchart illustrated in FIG. 6.

The controller 100 includes first position means 102 for receiving the sensor signals from the pair of first part sensors 74 to control the respective indicator lights 90, 91. When the instrument panel or first part 12 is properly positioned on the fixture 20, the sensors 74 transmits a signal, and the first position means 102 sends an actuate signal to the respective indicator light 90, 91. Second position means 104 is connected to the second part or door sensor 76 and is also connected to the door indicator 92 to indicate the presence and proper positioning of the door 14.

The rotate sensor 78 and return sensor 80 are connected to rotating means 106 for determining full rotation of the fixture 20 and full return of the fixture 20, and is also connected to the respective indicators 94, 95 to control indication thereof.

The controller 100 includes counting means 108 for counting the number of spent rivets detected by the rivet sensor 72 to provide indication of a current count. The counting means 108 receives the count signal and increments its count upon each rivet mandrel being detected. The controller 100 includes comparing means 110 for storing a predetermined count number, and upon actuation of the main control switch 82, comparing the stored number with the current count in the counting means 108, and initiating rotation to the returned position only when there is a predetermined relationship, i.e., equal.

The controller 100 includes disable means 112 for receiving disable signals from each of the position means 102, 104 and rotating means 106 and comparator 110 to prevent rotation if the parts 12, 14 are not properly installed, and to prevent return after rotation when the predetermined count has not been reached. The control switch 82 acts as a toggle switch between rotate and return positions.

The controller 100 is generally implemented by a programmable logic controller, and alternatively maybe so implemented any other type of computing or electronic system is commonly known in the art. A common computer 111 may be utilized in conjunction with the controller 100 to set the predetermined count number and any other information, or in place thereof.

Figure 6:
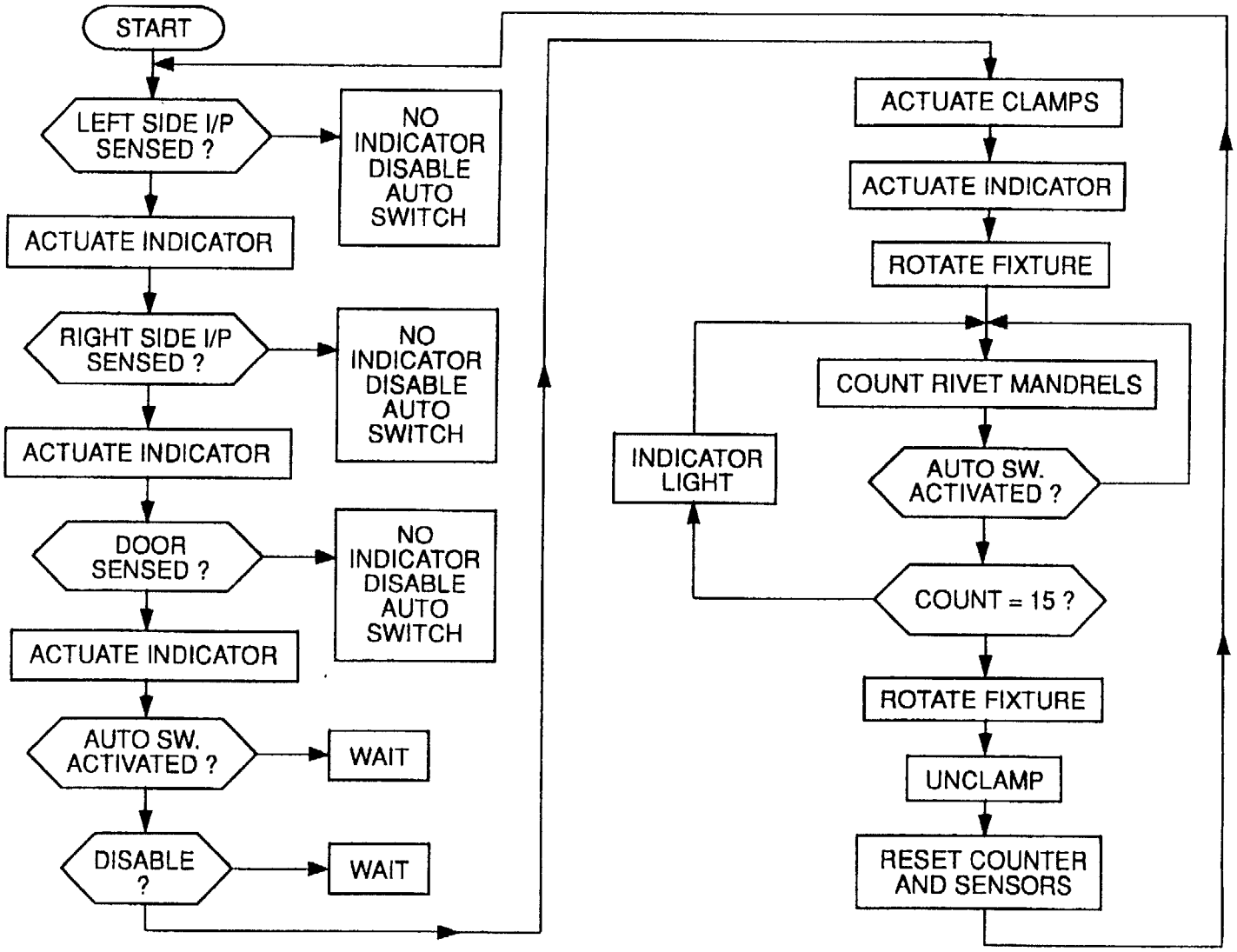
FIG. 6 is a flowchart of the controller of the subject invention.

The controller 100 operates under the flowchart illustrated in FIG. 6. In general, a frame 115 is initially placed on the support fixture 20, and thereafter the instrument panel 12 is positioned appropriately thereon. The controller 100 awaits detection of the left side of the instrument panel 12 and of the right side of the instrument panel 12. Upon proper placement and detection thereof, the first position means 102 actuates the respective indicator lights 90, 91 upon separate detection of the right and left sides. When the instrument panel 12 is not detected, no indicator 90, 91 is lit and a disable signal is produced. Thereafter, the door 14 is placed over the instrument panel 12 at the appropriate position, namely in the opening 32 provided by the instrument panel 12 and aligned with the frame 115. When the door sensor 76 detects the presence of the door 14, a signal is sent to the second position means 104 of the controller 100 which then provides indication thereof through the door indicator 92. Otherwise, a disable signal is produced.

Thereafter, the controller 100 waits actuation of the control switch 82. Upon actuation thereof, it is determined whether a disabled signal is received from one of the prior part sensors 74, 76. If a disable signal is received, no action occurs. Otherwise, the controller 100 automatically actuates the clamps 28 and provides indication thereof by the clamp indicator 94, 95. Thereafter, the fixture is rotated to its full rotated position as detected and verified by the rotate sensor 78. Thereafter, the operator may insert the required number of rivets, i.e., 15. Each spent mandrel is detected by the mandrel sensor 44 and provided to the controller 100. At any time the control switch 82 is actuated when less than 15 mandrels are counted, the alarm indicator 96 will light and the assembly 13 will not be rotated. Only when the proper count is reached and thereafter the control switch 82 has been activated will the fixture be rotated. Upon rotation, the clamps are automatically released and the sensors and mandrel counter reset.

An optional feature may include the rivet sensor 72 comprising a laser detector with its beam positioned through a clear glass tube portion of the vacuum tube 58. The laser detector 72 is capable of detecting presence of each spent mandrel 62 as previously discussed, and further allows determination of the length of the mandrel 62 to determine whether or not the rivet was properly crushed during installation. The controller 100 may include a length processor 120 for receiving the laser signal to calculate the length, and an additional error length indicator 122 may be included to alarm the user if the calculated length was not "proper". The length of the spent mandrel is calculated based on the force of vacuum or speed of vacuum pump, and the time the laser in interrupted, and resistance of the mandrel. A vacuum pressure sensor may be included and connected in the vacuum line 58 for instantaneously sensing vacuum pressure. Thereafter, based on commonly known principles, the speed of the rivet mandrel may be calculated. Thereafter, based on laser interruption time, the length of the mandrel may be calculated.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein the invention may be practiced otherwise than as specifically described.

What is claimed is:

1. A riveting system for ensuring the riveting together of at least two parts with a predetermined number of rivets at a workstation prior to removal of the resulting assembly from the workstation, said system comprising:

a support fixture located at the workstation for receiving the at least two parts;

a locking device operatively connected to said support fixture to hold and lock the at least two parts together on said support fixture;

a rivet setting tool operable to apply rivets to said at least two parts to connect the parts to one another forming an assembly; and a system control apparatus connected to said locking device and said rivet setting tool to prevent release of said locking device and the parts until determining a predetermined number of rivets have been applied.

2. A system as set forth in claim 1 wherein said locking device includes a plurality of automatic clamps for locking each of the two members, said automatic clamps connected to and controlled by said system control apparatus.

3. A system as set forth in claim 1 wherein said rivet setting tool includes a vacuum tube for receiving spent rivet mandrels after application of each rivet.

4. A system as set forth in claim 3 further including a rivet sensor connected to said vacuum tube for detecting the presence of a spent rivet mandrel in said vacuum tube and for producing a count signal upon detection of each of said spent rivet mandrel.

5. A system as set forth in claim 3 wherein said system control apparatus includes a controller for receiving said count signal and providing a completed indication when said predetermined number of rivets have been detected.

6. A system as set forth in claim 5 wherein said controller includes clamp means for releasing said locking device upon detecting said predetermined number of spent mandrels.

7. A system as set forth in claim 1 wherein said support fixture comprises a first support portion for supporting the first part and a second support portion for supporting the second part in predetermined positions.

8. A system as set forth in claim 1 further including an actuator assembly for activating and deactivating the locking device for rotating said support fixture between a rotated and returned position to allow riveting of the parts in the rotated position with the locking device locking the two parts to the support fixture.

9. A system as set forth in claim 8 wherein said actuator assembly comprises first and second part actuators for controlling clamping and unclamping of said locking device in response to a control signal separately for each part.

10. A system as set forth in claim 9 wherein said actuator assembly includes a rotating actuator for controlling rotation of said support fixture with respect to the workstation in response to a control signal and for controlling return of said support fixture to a return position.

11. A system as set forth in claim 10 wherein said actuator assembly is pneumatically controlled.

12. A system as set forth in claim 1 wherein a system control apparatus includes a pair of first part sensors for determining the proper placement and presence of the first part and for producing a signal upon detection thereof.

13. A system as set forth in claim 12 wherein said system control apparatus includes second part sensor for detecting the presence and proper placement of the second part and for producing a signal indicative thereof.

14. A system as set forth in claim 13 wherein said system control apparatus includes a rotate sensor for indicating complete rotation of said support fixture and a return sensor indicating return of said support fixture to said return position and for producing control signals indicative of the detections thereof.

15. A system as set forth in claim 14 wherein said system control apparatus includes a status panel for indicating statuses of said system control apparatus.

16. A system as set forth in claim 15 wherein said control apparatus includes a controller for receiving the control signals from said sensors and for controlling the support fixture and status panel and locking device.

17. A system as set forth in claim 16 wherein said controller includes first position means for receiving said sensor signals from said pair of first part sensors and for visually indicating proper positioning of said first part.

18. A system as set forth in claim 17 wherein said controller includes second position means connected to said second part sensor for visually indicating the proper positioning of said second part.

19. A system as set forth in claim 18 further including rotating means connected to said rotate sensor and said return sensor for visually indicating full rotation and full return of said support fixture.

20. A system as set forth in claim 19 further including counting means connected to said rivet sensor for counting the number of spent rivet mandrels.

21. A system as set forth in claim 20 further including comparing means for storing a predetermined count number and for comparing said predetermined count number to said counting number to determine when said rivet sensor has detected said predetermined count number and for visually indicating same.

* * * * *